US006000786A

United States Patent [19]

Larson

[11] Patent Number: 6,000,786

[45] Date of Patent: Dec. 14, 1999

[54] METHOD AND APPARATUS FOR USING DUAL PRINT ZONES TO ENHANCE PRINT QUALITY

[75] Inventor: Ove Larson, Västra Frölunda, Sweden

[73] Assignee: Array Printers Publ. AB, Vastra Frolunda, Sweden

[21] Appl. No.: 08/787,435

[22] Filed: Jan. 22, 1997

Related U.S. Application Data

[63] Continuation-in-part of application No. 08/530,701, Sep. 19, 1995.

[51] Int. Cl.[6] ..... B41J 2/06; B41J 2/385; G03G 9/08

[52] U.S. Cl. ..... 347/55; 347/156

[58] Field of Search ..... 347/55, 158, 86, 347/89, 125, 151

[56] References Cited

U.S. PATENT DOCUMENTS

| | | |
|---|---|---|
| 3,566,786 | 3/1971 | Kaufer et al. . |
| 3,689,935 | 9/1972 | Pressman et al. . |
| 3,779,166 | 12/1973 | Pressman et al. . |
| 3,815,145 | 6/1974 | Tisch et al. . |
| 4,263,601 | 4/1981 | Nishimura et al. . |
| 4,274,100 | 6/1981 | Pond . |
| 4,353,080 | 10/1982 | Cross et al. . |

(List continued on next page.)

FOREIGN PATENT DOCUMENTS

| | | |
|---|---|---|
| 0345 024 A2 | 6/1989 | European Pat. Off. . |
| 0352 997 A2 | 1/1990 | European Pat. Off. . |
| 0377 208 A2 | 7/1990 | European Pat. Off. . |
| 0389 229 | 9/1990 | European Pat. Off. . |
| 0660 201 A2 | 6/1995 | European Pat. Off. . |
| 072 072 A2 | 7/1996 | European Pat. Off. . |
| 0 743 572 A1 | 11/1996 | European Pat. Off. . |
| 0752 317 A1 | 1/1997 | European Pat. Off. . |
| 0764 540 A2 | 3/1997 | European Pat. Off. . |
| 12 70 856 | 6/1968 | Germany . |

(List continued on next page.)

OTHER PUBLICATIONS

E. Bassous, et al., "The Fabrication of High Precision Nozzles by the Anisotropic Etching of (100) Silicon", *J. Electrochem. Soc.: Solid–State Science and Technology*, vol. 125, No. 8, Aug. 1978, pp. 1321–1327.

Jerome Johnson, "An Etched Circuit Aperture Array for TonerJet® Printing", *IS&T's Tenth International Congress on Advances in Non–Impact Printing Technologies*, 1994, pp. 311–313.

"The Best of Both Worlds," Brochure of Toner Jet® by Array Printers, *The Best of Both Worlds*, 1990.

*Primary Examiner*—Benjamin R. Fuller
*Assistant Examiner*—Raquel Yvette Gordon
*Attorney, Agent, or Firm*—Knobbe, Martens, Olson & Bear, LLP

[57] ABSTRACT

A printer unit of a printer device having at least one printer unit which includes at least one toner container for toner particles and an electrode unit, including electrodes and apertures surrounded at least partly by the electrodes. The electrode unit is arranged to control the transportation of the toner particles by means of attraction fields from a toner carrier member arranged in the toner container or in a space communicating with it towards a back electrode and an information carrier insertable between the toner carrier member and the back electrode. The toner carrier member, the electrode unit, and/or the back electrode are arranged to form a transportation zone between two most remote transversal electrodes and generate the attraction fields, which through the apertures attract the toner particles towards the back electrode. The transportation zone consists of at least two smaller zones including, in the toner container or in a space communicating with it, a number of toner carrier members corresponding to the number of the zones and groups of electrode units consisting of apertures and electrodes having reduced numbers and/or sizes.

33 Claims, 8 Drawing Sheets

U.S. PATENT DOCUMENTS

| | | |
|---|---|---|
| 4,382,263 | 5/1983 | Fischbeck et al. . |
| 4,384,296 | 5/1983 | Torpey . |
| 4,386,358 | 5/1983 | Fischbeck . |
| 4,470,056 | 9/1984 | Galetto et al. . |
| 4,478,510 | 10/1984 | Fujii et al. . |
| 4,491,794 | 1/1985 | Daley et al. . |
| 4,491,855 | 1/1985 | Fujii et al. . |
| 4,498,090 | 2/1985 | Honda et al. . |
| 4,511,907 | 4/1985 | Fukuchi . |
| 4,525,727 | 6/1985 | Kohashi et al. . |
| 4,571,601 | 2/1986 | Teshima . |
| 4,675,703 | 6/1987 | Fotland . |
| 4,717,926 | 1/1988 | Hotomi . |
| 4,743,926 | 5/1988 | Schmidlin et al. . |
| 4,748,453 | 5/1988 | Lin et al. . |
| 4,814,796 | 3/1989 | Schmidlin . |
| 4,831,394 | 5/1989 | Ochiai et al. . |
| 4,837,071 | 6/1989 | Tagoku et al. . |
| 4,860,036 | 8/1989 | Schmidlin . |
| 4,903,050 | 2/1990 | Schmidlin . |
| 4,912,489 | 3/1990 | Schmidlin . |
| 5,028,812 | 7/1991 | Bartky . |
| 5,036,341 | 7/1991 | Larsson . |
| 5,038,159 | 8/1991 | Schmidlin et al. . |
| 5,057,855 | 10/1991 | Damouth . |
| 5,072,235 | 12/1991 | Slowik et al. . |
| 5,083,137 | 1/1992 | Badyal et al. . |
| 5,095,322 | 3/1992 | Fletcher . |
| 5,121,144 | 6/1992 | Larson et al. . |
| 5,128,695 | 7/1992 | Maeda . |
| 5,148,595 | 9/1992 | Doggett et al. . |
| 5,170,185 | 12/1992 | Takemura et al. . |
| 5,181,050 | 1/1993 | Bibl et al. . |
| 5,204,696 | 4/1993 | Schmidlin et al. . |
| 5,204,697 | 4/1993 | Schmidlin . |
| 5,214,451 | 5/1993 | Schmidlin et al. . |
| 5,229,794 | 7/1993 | Honman et al. . |
| 5,235,354 | 8/1993 | Larson . |
| 5,237,346 | 8/1993 | Da Costa et al. . |
| 5,256,246 | 10/1993 | Kitamura . |
| 5,257,045 | 10/1993 | Bergen et al. . |
| 5,270,729 | 12/1993 | Stearns . |
| 5,274,401 | 12/1993 | Doggett et al. . |
| 5,307,092 | 4/1994 | Larson . |
| 5,329,307 | 7/1994 | Takemura et al. . |
| 5,374,949 | 12/1994 | Wada et al. . |
| 5,386,225 | 1/1995 | Shibata . |
| 5,402,158 | 3/1995 | Larson . |
| 5,414,500 | 5/1995 | Furukawa . |
| 5,446,478 | 8/1995 | Larson . |
| 5,450,115 | 9/1995 | Bergen et al. . |
| 5,453,768 | 9/1995 | Schmidlin . |
| 5,473,352 | 12/1995 | Ishida . |
| 5,477,246 | 12/1995 | Hirabayashi et al. . |
| 5,477,250 | 12/1995 | Larson ..... 347/55 |
| 5,506,666 | 4/1996 | Masuda et al. . |
| 5,508,723 | 4/1996 | Maeda . |
| 5,515,084 | 5/1996 | Larson . |
| 5,526,029 | 6/1996 | Larson et al. . |
| 5,558,969 | 9/1996 | Uyttendaele et al. . |
| 5,600,355 | 2/1997 | Wada . |
| 5,614,932 | 3/1997 | Kagayama . |
| 5,617,129 | 4/1997 | Chizuk, Jr. et al. . |
| 5,625,392 | 4/1997 | Maeda . |
| 5,640,185 | 6/1997 | Kagayama . |
| 5,650,809 | 7/1997 | Kitamura . |
| 5,666,147 | 9/1997 | Larson . |
| 5,677,717 | 10/1997 | Ohashi . |
| 5,708,464 | 1/1998 | Desie . |
| 5,774,159 | 6/1998 | Larson . |
| 5,805,185 | 9/1998 | Kondo . |
| 5,818,480 | 10/1998 | Bern et al. . |
| 5,818,490 | 10/1998 | Larson . |

FOREIGN PATENT DOCUMENTS

| | | |
|---|---|---|
| 26 53 048 | 5/1978 | Germany . |
| 44-26333 | 11/1969 | Japan . |
| 55-55878 | 4/1980 | Japan . |
| 55-84671 | 6/1980 | Japan . |
| 55-87563 | 7/1980 | Japan . |
| 56-89576 | 7/1981 | Japan . |
| 58-044457 | 3/1983 | Japan . |
| 58-155967 | 9/1983 | Japan . |
| 62-13356 | 11/1987 | Japan . |
| 01120354 | 5/1989 | Japan . |
| 05220963 | 8/1990 | Japan . |
| 04189554 | 8/1992 | Japan . |
| 4282265 | 10/1992 | Japan . |
| 5208518 | 8/1993 | Japan . |
| 93331532 | 12/1993 | Japan . |
| 94200563 | 8/1994 | Japan . |
| 9048151 | 2/1997 | Japan . |
| 9118036 | 5/1997 | Japan . |
| 2108432 | 5/1983 | United Kingdom . |
| 9014960 | 12/1990 | WIPO . |
| 9201565 | 2/1992 | WIPO . |

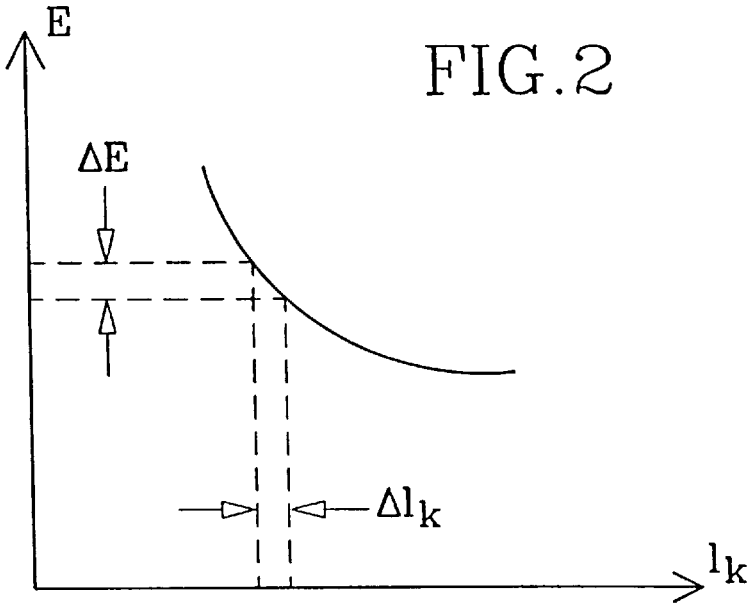
FIG.2
FIG.4
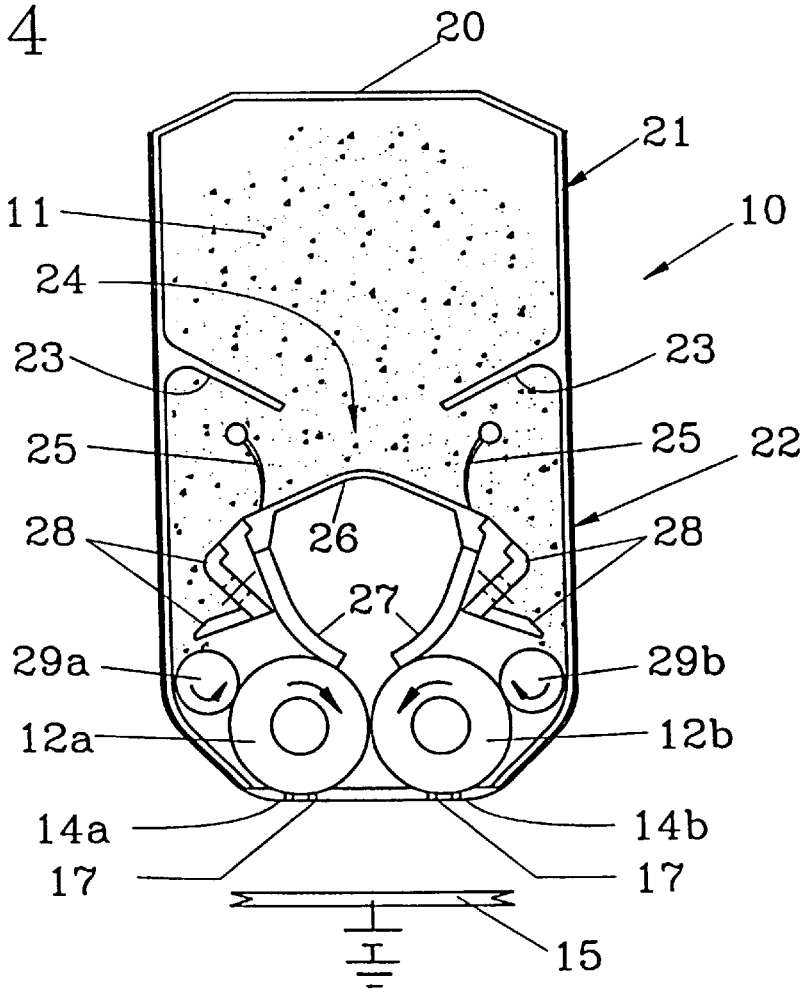

METHOD AND APPARATUS FOR USING DUAL PRINT ZONES TO ENHANCE PRINT QUALITY

RELATED APPLICATIONS

This application is a continuation-in-part of U.S. patent application No. 08/530,701 filed on Sep. 19, 1995, which claims priority from Swedish Application No. 9403143-2 filed Sep. 19, 1994.

FIELD OF THE INVENTION

The present invention pertains to a printer device having a toner container for toner particles and an electrode unit to control the transportation of the toner particles towards a back electrode and an information carrier.

BACKGROUND OF THE INVENTION

In U.S. Pat. No. 5,036,351, a method and a device are known for producing images on an information carrier, e.g., paper, by means of electrostatic fields and using an electrode unit between a toner carrier member, so-called developer, and a back electrode.

The electrode unit can be formed as a woven net, consisting of electrodes crossing each other. Net meshes are arranged between the electrodes, through which toner particles are attracted from the toner carrier member towards the back electrode. By connecting electrodes, surrounding the meshes of the net, to different voltages, passages for the toner particles via meshes are opened and closed.

The electrode unit can also consist of a thin substrate, arranged with pervious apertures, which are surrounded by the electrodes, so-called ring electrodes. Such electrode units are described in U.S. Pat. No. 5,121,144.

Another type of electrode unit is shown, for example, in UK 2 108 432, in which two electrode layers are arranged on each side of a conveyer, and the electrodes surround pervious holes to modulate particles from a toner carrier member towards a back electrode through the holes.

FIG. 1 shows a schematic view of a printer unit 10 according to SE 9000031-6 or SE 8704883-1. The toner particles 11, which are adhered onto the toner carrier member by means of magnetic or similar forces, are transported from the toner carrier member 12 towards a back electrode 15 via the electrode unit by means of electrostatic fields. One condition to obtain transportation of the toner particles from the toner carrier member 12 onto an information carrier 13 with a good result is that the distance $l_k$ between the toner carrier member 12 and the electrode unit 14 is so short that the strength of the field that transports the toner particles is as strong as possible. The transportation field between the toner carrier member 12 and the back electrode 15 is obtained, for example, by connecting the toner carrier member to ground (0 V) and the back electrode to 1.5 kV. By connecting the electrodes 16 in the electrode unit 14 to a variable control voltage $V_0$, for example 300 V, passages through apertures 17 are generated. The size of these passages can be varied to allow the transporting field to pass entirely, partly, or not at all through the apertures and convey toner particles in the direction towards the back electrode 15 and onto an information carrier 13 placed between the back electrode and the toner carrier member 12, such as a paper sheet.

The toner carrier member 12 is rotatably arranged in a toner container (not shown) and attracts toner particles by means of, for example, magnets (not shown) provided inside the toner carrier member. The toner particles 11 attracted onto the toner carrier member are leveled to a layer on the surface of the toner carrier member, which can include conducting or semiconducting material.

The toner carrier member is typically formed as a roller with a circular cross section, and the electrode unit is generally formed flat. Due to the cylindrical form of said roller, the distance $l_k$ from the surface of the roller to the apertures 17 varies. The variation is designated with $\Delta l_k$. For example, the distance from the toner carrier member to the apertures A2 and A3 is shorter than to the apertures A1 and A4, with respect to a perpendicular line (not shown) from the center of the roller to a point between apertures A2 and A3.

The schematic graph of FIG. 2 shows the relationship between the distance $l_k$ and the electrostatic field E for attracting the toner particles in a direction towards the back electrode. Variations in $\Delta l_k$ result in variations in the electrostatic field E, which in turn causes variations in the number of toner particles which are attracted towards the surface of the information carrier 13. Said variations in the amount of the toner particles affect the printing quality and cause undesired variations in the produced image.

Another problem that may occur is at color intensive prints. This problem, so-called "white line noise," which is best illustrated in FIGS. 1 and 3, results in appearance of lighter lines in the image, because the toner particles on the toner carrier member are not enough for all apertures of the electrode unit.

In FIG. 3 the arrow shows the rotation direction of the toner carrier member. If, for instance, apertures A1–A4 are opened in numerical order, some portion of the toner particles 18 will be transported onto the information carrier 13 in a consecutive order, then the aperture A1 will receive the most of the toner, while the subsequent apertures receive lesser and lesser amounts. At aperture A4 the amount of the toner may be so much lesser that a deterioration in the printing quality occurs.

Another problem is that the toner particles "see" the conductive electrodes 16, as a source of the fields, which attract the toner particles. Lines illustrated with dots and dashes show the areas A'1–A'4, B'1 and B'2, which affect the toner particles on the toner carrier member. The shadowed areas show how the toner particles will be applied, i.e., will be transported onto the information carrier. It appears from the figures that B1 will also affect the printing area of A4.

Yet another problem which may arise is the so-called "curtain effect," where a large area image has reduced blackness at the beginning of the printing, followed by normal blackness after a short distance. This problem occurs when several adjacent electrodes 16 are energized at the same time to produce a large area image. The combined electric field of several adjacent energized conductors 19 is strong enough to attract the toner particles from the toner carrier member to the conductors. Diversion of those toner particles reduces the number of toner particles deposited on the paper, causing a less black image. The diversion of the particles soon becomes saturated, allowing normal black printing to occur for the remainder of that image portion. At the end of printing that image portion, the toner particles are attracted back onto the toner carrier member.

SUMMARY OF THE INVENTION

The object of the present invention is to eliminate the above-described obstacles, i.e., "white line noise" and the "curtain effect," so that the printing quality is improved.

These objects are overcome by dividing a transportation or print zone in at least two smaller zones, including in said toner container or in a space communicating with the container, a number of toner carrier members corresponding to the number of the zones and groups of electrode units consisting of apertures and electrodes having reduced numbers and/or sizes.

BRIEF DESCRIPTION OF THE DRAWINGS

The invention will be described with reference to the drawings showing some embodiment.

FIG. 2 shows a diagram schematically illustrating the relationship between the distance of the toner carrier member and the apertures in the electrode unit.

FIG. 4 schematically shows a cross section through a part of a preferred printer unit, according to the invention.

DESCRIPTION OF THE PREFERRED EMBODIMENTS

Figure 1:
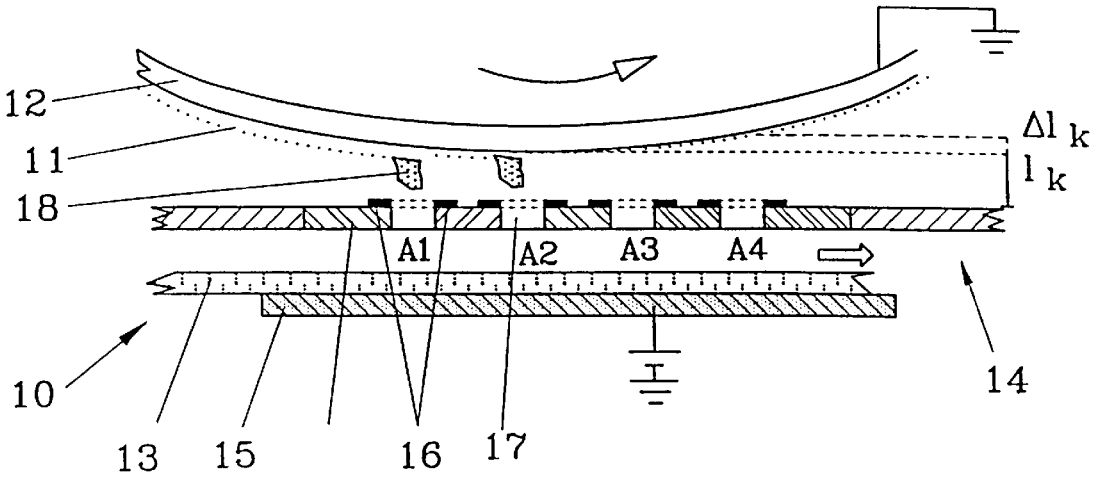
FIG. 1 shows a section through a printer unit in enlarged scale, according to the prior art.

The embodiment of a printer unit 10 shown in FIG. 4 includes a casing 20 comprising a toner container portion 21 and a toner carrier portion 22. The toner container portion 21 is arranged with delimitation bars 23 defining an opening 24 through which the container portion 21 communicates with the lower part, the toner carrier portion 22. In the lower part, mixing blades 25 are arranged which are operated directly or indirectly by means of driving means (not shown). In the toner carrier portion 22, a supporting member 26 is arranged and provided with scraping knifes 27, so-called doctor blades, and guiding bars 28. At least two distribution rollers 29*a* and 29*b* are arranged in at least direct contact with the toner carrier members 12*a* and 12*b*. In the bottom of the casing at least two electrode units 14*a* and 14*b* are arranged. The toner container portion 21 can also be arranged separately and be mounted to the casing 20.

When the printer unit operates, the toner particles 11 stream through the opening 24 towards the supporting member 26, which is provided with shanks angled relative to each other, which direct the particle flow towards the guide bars 28. The mixing blades 25 are rotatably arranged to prevent the particles from sticking together and forming lumps that disturb the flow. Guide bars 28 guide the particle flow towards the two distribution rollers 29*a* and 29*b*, which rotate in a direction opposite to the rotation direction of the toner carrier member. The distribution rollers 29*a* and 29*b* may consist of some suitable material, such as foam rubber, or may be arranged with brushes or the like. The toner particles transported to the toner carrier members 12*a* and 12*b* are leveled to a layer by means of the doctor blades 27.

The electrodes are connected to the driving circuits of known types (not shown) and may be controlled simultaneously or one by one. For example, by connecting the toner carrier members to earth (0 V), by connecting the back electrode 15 to 1.5 KV, and by controlling the electrodes by 300 V, passages through the apertures 17 are at least partly opened or closed. Attraction fields pass through the passages and attract the toner particles from the toner carrier members 12*a* and 12*b* in the direction towards the back electrode 15. The back electrode 15 can be commonly arranged for both electrode units 14*a* and 14*b*, for each electrode unit 14*a* or 14*b*, or one back electrode for each aperture 17.

By inserting an information carrier (for example, a paper sheet) between the toner carrier members 12*a*, 12*b* and the back electrodes 15 and by applying suitable control voltages, passages are opened through the apertures 17, and the toner particles are transported onto the paper and fixed on it when the paper passes a heating means or fuser (not shown).

The above-mentioned problems are solved by dividing the electrode unit 14 in two or more parts 14*a* and 14*b*, depending on the application area. The length of the print zone 35 (FIG. 3) is reduced (W'>W/2 (FIGS. 3 and 6)), which allows reducing the radius of the toner carrier member, resulting in a significant reduction of $\Delta l_k$ and improvement of the printing quality. The reduction of the print zone length is achieved, for instance, by bringing the electrodes closer together when one interjacent electrode is moved to the other print zone. Since toner particles from each carrier member are distributed through two apertures in a series of openings, according to the embodiments shown in FIGS. 4–6, instead of four apertures, according to the embodiment shown in FIGS. 1 and 3, a more uniform distribution of toner particles onto the information carrier is obtained. Also, the "curtain effect" is eliminated as a result of the reduced conductor area and because the toner carrier members do not need to rotate in the same direction that the conductors extend to the ring electrodes.

Figure 5:
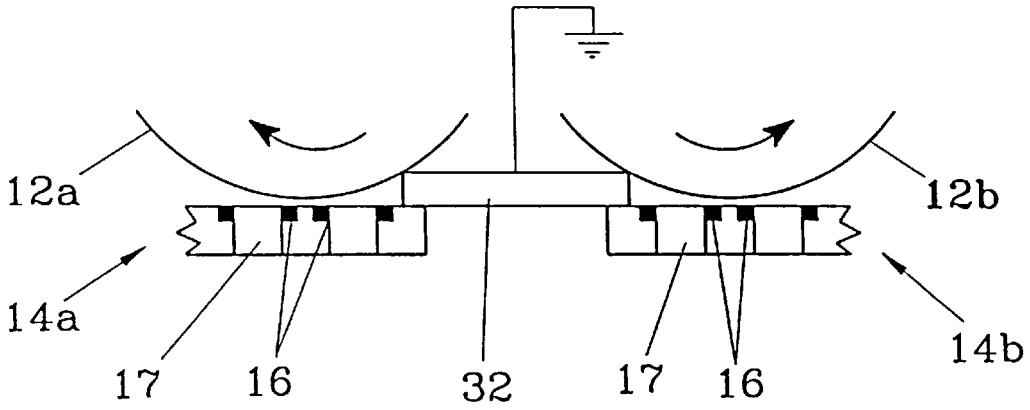
FIG. 5 illustrates a schematic cross section through an enlarged part of the print zone in a second embodiment, according to the present invention.

FIG. 5 shows an enlarged view of a part of another embodiment according to the invention. Both toner carrier members 12*a*, 12*b* cooperate with a spacer means 32 connected to earth. Also, this spacer means 32 may operate as a doctor blade and also as shielding means against fields that extend from some of the electrodes and disturb the field image in the other electrode unit. By field image it is meant the appearance of the fields.

Figure 3:
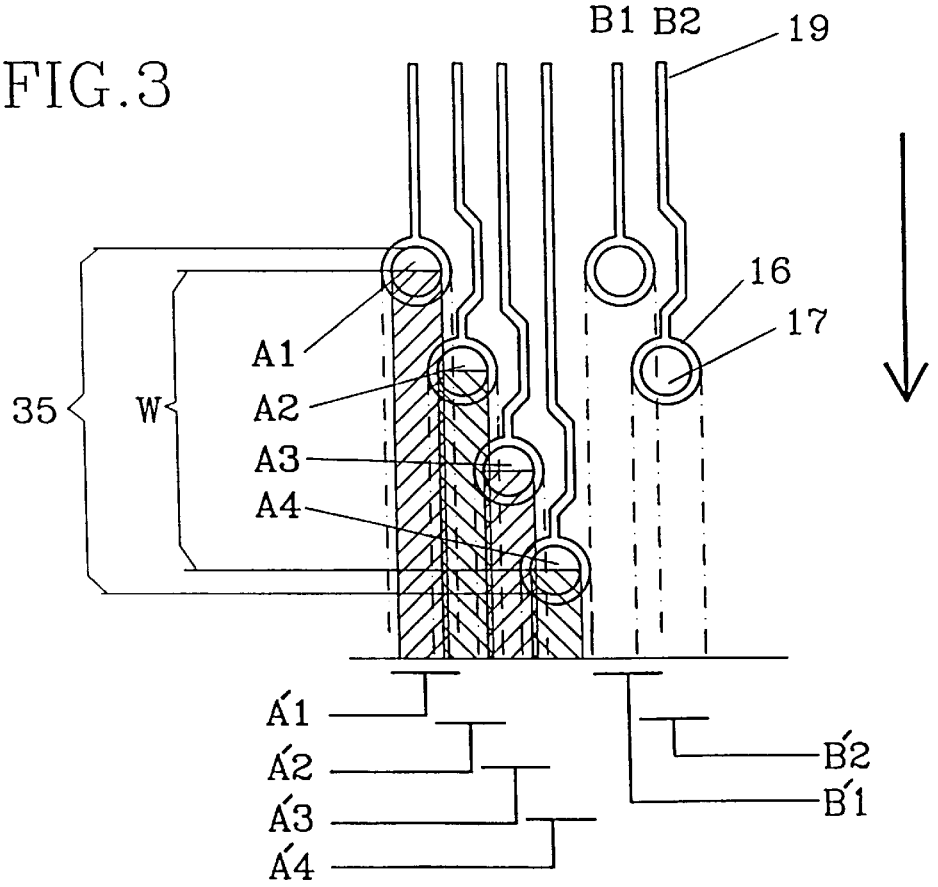
FIG. 3 shows, from above and in a large scale, a schematic view of a part of an electrode unit.
Figure 6:
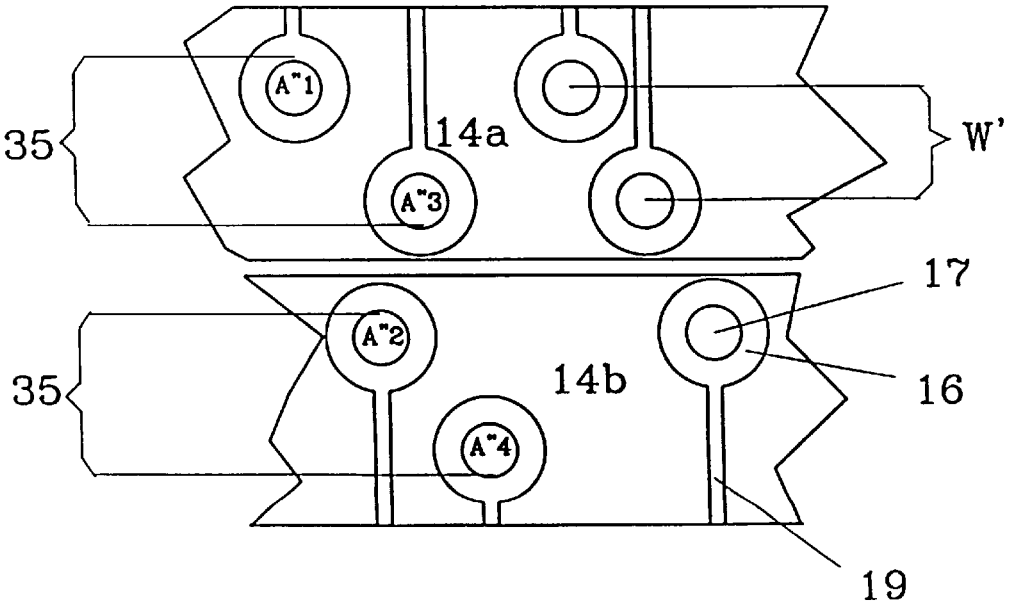
FIG. 6 shows a schematic elevation view of a part of the electrode units, according to the invention.

FIG. 6 shows a part of the electrode units 14*a* and 14*b* from above, where designation symbols A"1–A"4 correspond to the designation symbols A1–A4 in FIG. 3. Preferably, the most adjacent electrodes A"1, A"3 and A"2, A"4, respectively, in each group 14*a* and 14*b* are arranged with the same lateral distance.

Figure 7:
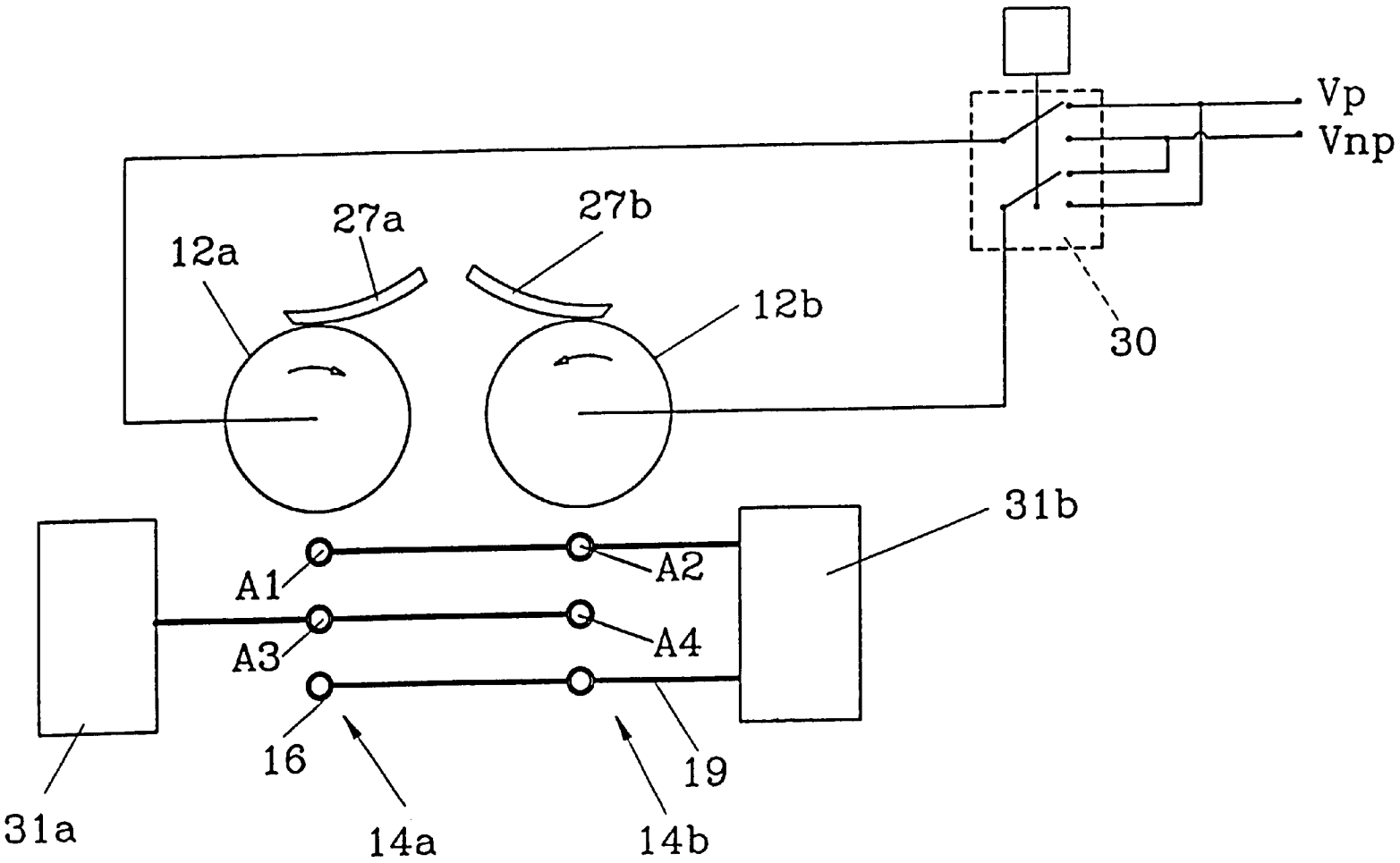
FIG. 7 shows schematically another embodiment, according to the present invention, in which the toner carrier members are used to control the toner transportation.

In the embodiment shown in FIG. 7, the toner carrier members 12*a* and 12*b* are connected through a switching means 30 to control voltages, Vp and Vnp. The switching means 30 may consist of multiplexing circuits, circuit breakers, or the like. The electrodes 16 of the electrode units 14*a* and 14*b* are grouped in at least two groups, depending on the number of the printing zones 35, by coupling them to two driving circuits 31. The driving circuits are preferably of conventional type, supplying the electrodes with high control voltages according to the signals from a main control unit (not shown). In operation, the voltages Vp and Vnp represent printing and nonprinting voltages; i.e., when the switching means 30 connects one of the toner carrier members 12*a* or 12*b* to the Vp, for example, the toner carrier member 12*a*, a transportation of the toner particles from the toner carrier member 12*a* will be possible when electrodes A1 or A3 are energized with a suitable voltage. At the same time, if the toner carrier member 12*b* is connected to Vnp, no transportation of the toner particles from the toner carrier member 12*b* will be obtained, even though the electrodes A2 and A4 are connected to a printing voltage through the driving circuits 31*a* and 31*b*. Of course, it is possible to provide divided back electrodes and switch them, as in the above description.

Also, another type of doctor blades 27*a* and 27*b* is illustrated in this embodiment which scrapes off the toner particles from the toner carrier member and levels the particles by smoothing them on the toner carrier member.

Figure 8:
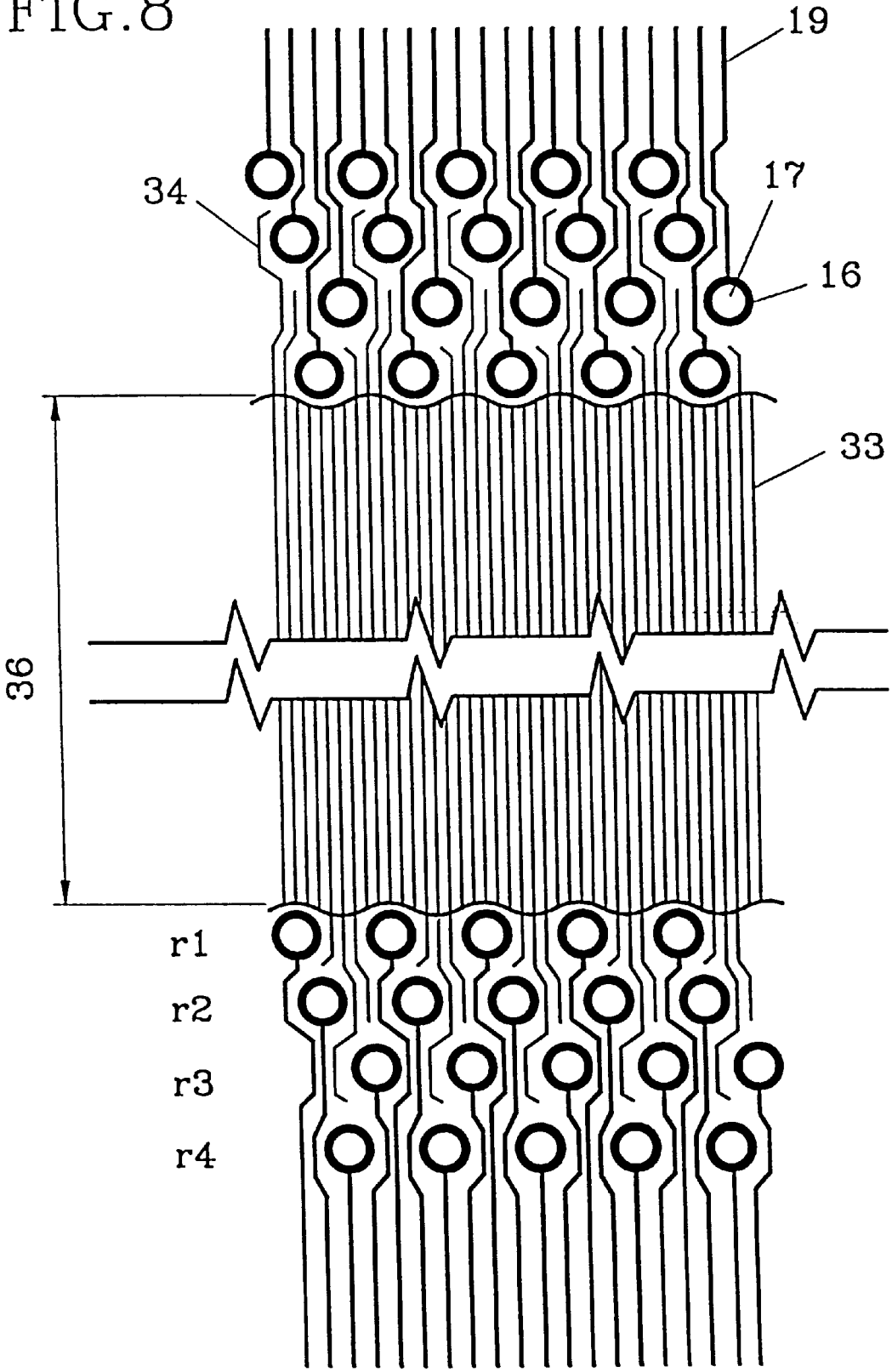
FIG. 8 shows a preferred embodiment of an electrode unit, according to the invention.

A preferred embodiment of the electrode unit 14 is shown in FIG. 8. This electrode unit is designed for printing 600 dpi (dots per inch). The aforementioned electrode units 14 were designed for 300 dpi printing, but the solutions used in this embodiment may as well be applied to any electrode unit according to the present invention. Referring to FIG. 8, the electrode unit includes an area 36 comprising joined conductors 33. This area is generally connected to the same voltage that is applied to the electrodes 16 to prevent transportation of toner particles from the toner carrier member onto the information carrier. Some conductors 34 extend from the area 36 between the ring electrodes 16 in order to shield two adjacent ring electrodes 16 to reduce the interferences between the ring electrodes that may occur when printing.

It is also possible to further tune up the print zones. Referring to FIG. 8, where the distance between the toner carrier member and the electrodes 16 of rows r1 and r4 is longer than rows r2 and r3, it is possible to increase the voltage applied to the electrodes of the first rows, i.e., $V_{r1,r4}>V_{r2,r3}$, where $V_{rx}$ is the voltage applied to the electrodes of the row x.

It is also possible to vary the size of the electrodes, i.e., $S_{r1,r4}<S_{r2,r3}$, where $S_{rx}$ is the size of the electrodes of the row x, to obtain higher concentrations of the electrostatic fields in the smaller electrodes, i.e., those having longer distances to the toner carrier member.

Figure 9:
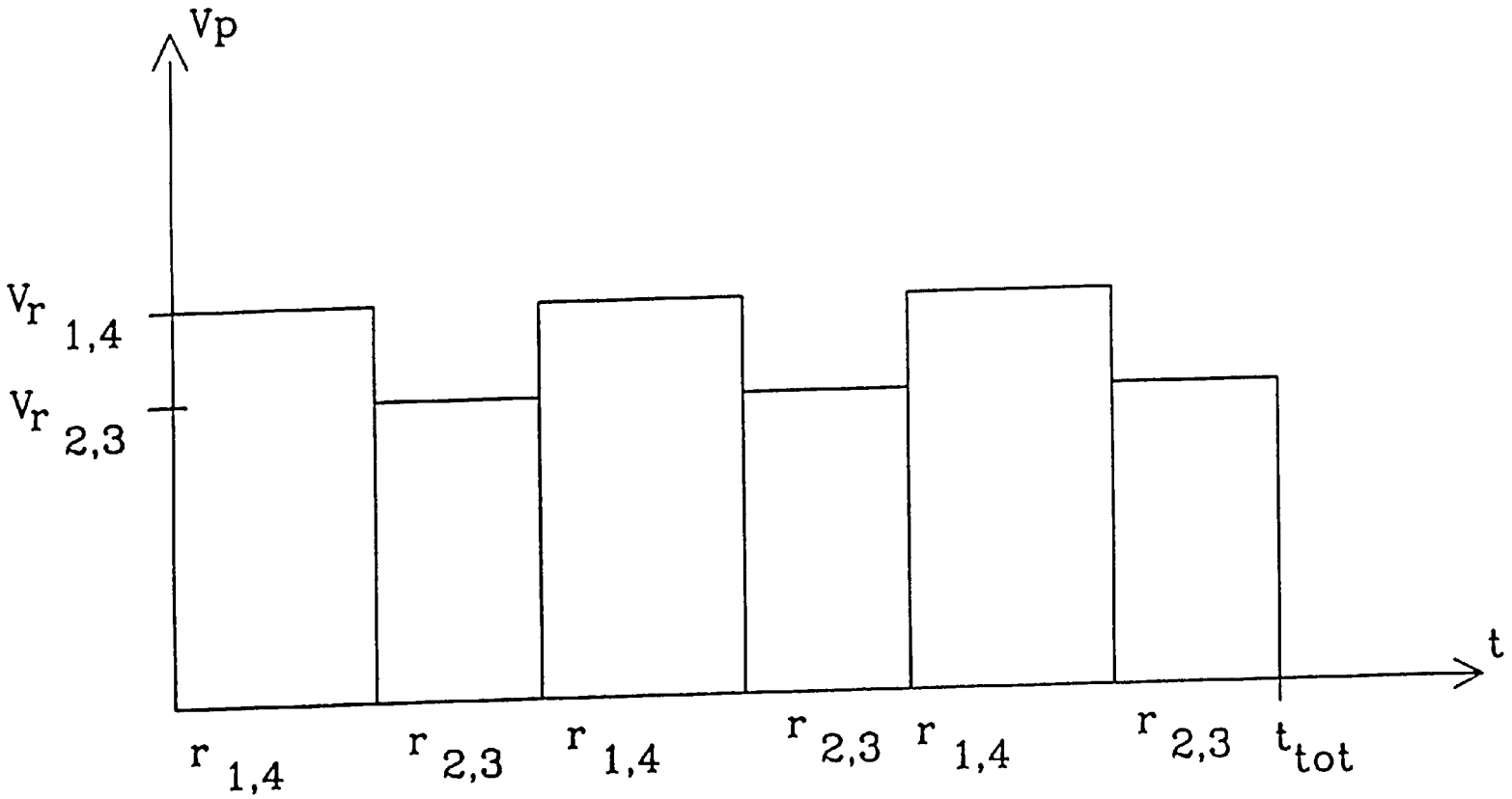
FIG. 9 shows a timing diagram.

Yet another possibility is to vary the active printing time $t_p$ of rows by dividing or pulsing the total printing time $t_{tot}$, which is illustrated in the graph of FIG. 9. In this case the print time for rows r1 and r4 is longer than for rows r2 and r3. Also, the voltage level for r1 and r4 is higher than that for r2 and r3. Referring back to FIG. 8, the same timing and voltage application may be applied to the rows of the upper part of the drawing, whereby the apertures of upper part overlap the apertures of the lower part.

Also, the invention may be used in printers including other electrode units than the above-described types. The electrodes may consist of the types that are described in U.S. Pat. No. 5,036,341, which include a woven electrode net. The electrode unit may also consist of the type that is described in UK 2 108 432 in which the electrodes surrounding pervious apertures arranged on both sides of an insulator and modulate the toner particles through the apertures. Even though the described embodiments generally show printer units having divided print zones, it is obvious for a person skilled in the art that some solutions can be applied in printer units having one print zone or printing devices employing several print units.

Figure 10:
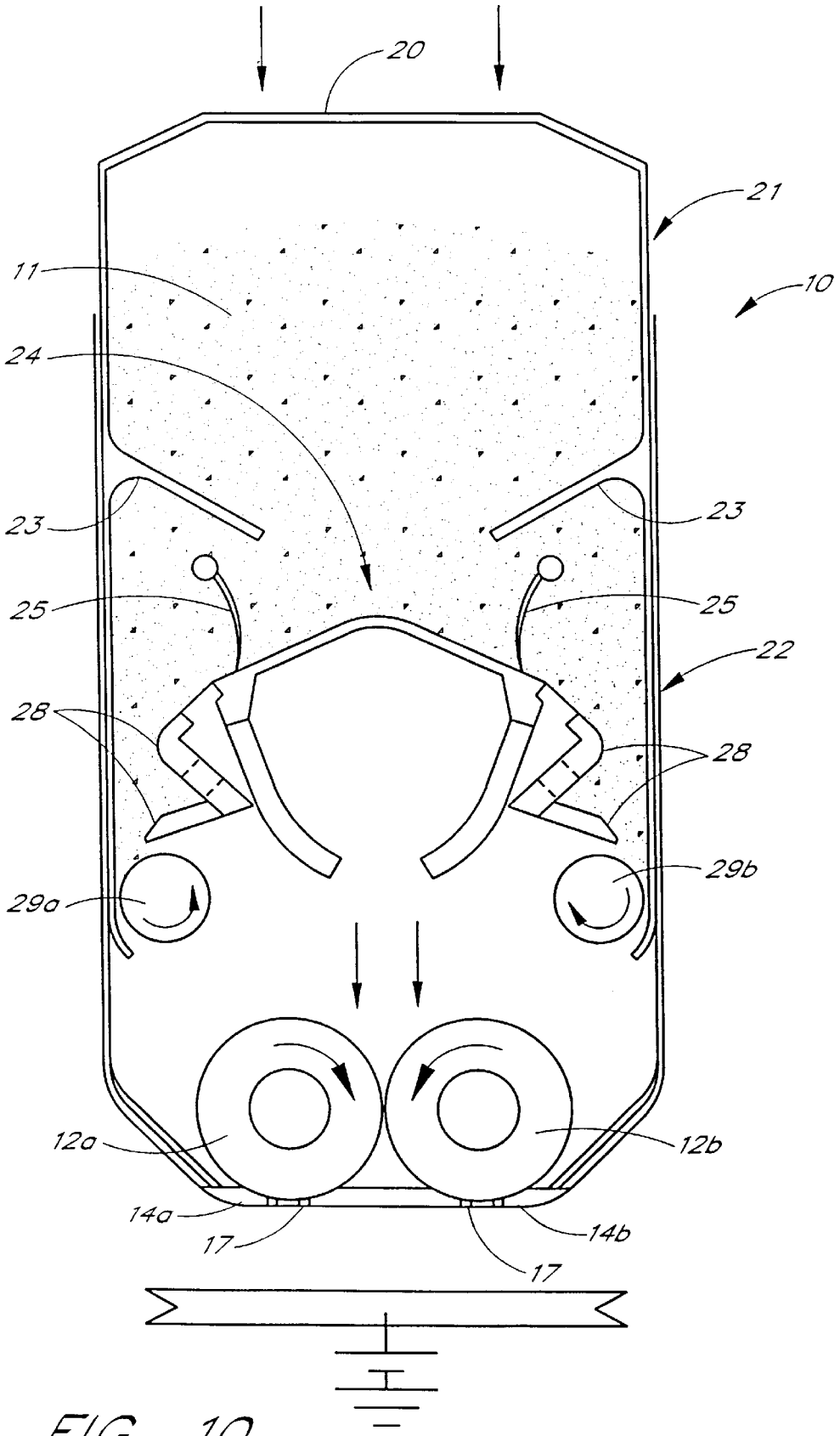
FIG. 10 illustrates an alternative embodiment wherein the toner container is replaceable without replacing the toner carrier members and the electrode units.

In FIG. 4, a single casing 20 encloses the toner particles 11, the delimitation bars 23, the mixing blades 25, the supporting member 26, the scraping blades 27, the guiding bars 28, the distribution rollers 29*a*, 29*b*, the toner carrier members 12*a*, 12*b* and the electrode units 14*a*, 14*b*. In an alternative embodiment illustrated in FIG. 10, the toner carrier members 12*a*, 12*b* and the electrode units 14*a*, 14*b* are part of the print unit 10 rather than being part of the casing 20. In FIG. 10, the casing 20 is shown just prior to installation in the printer unit 10.

Figure 11:
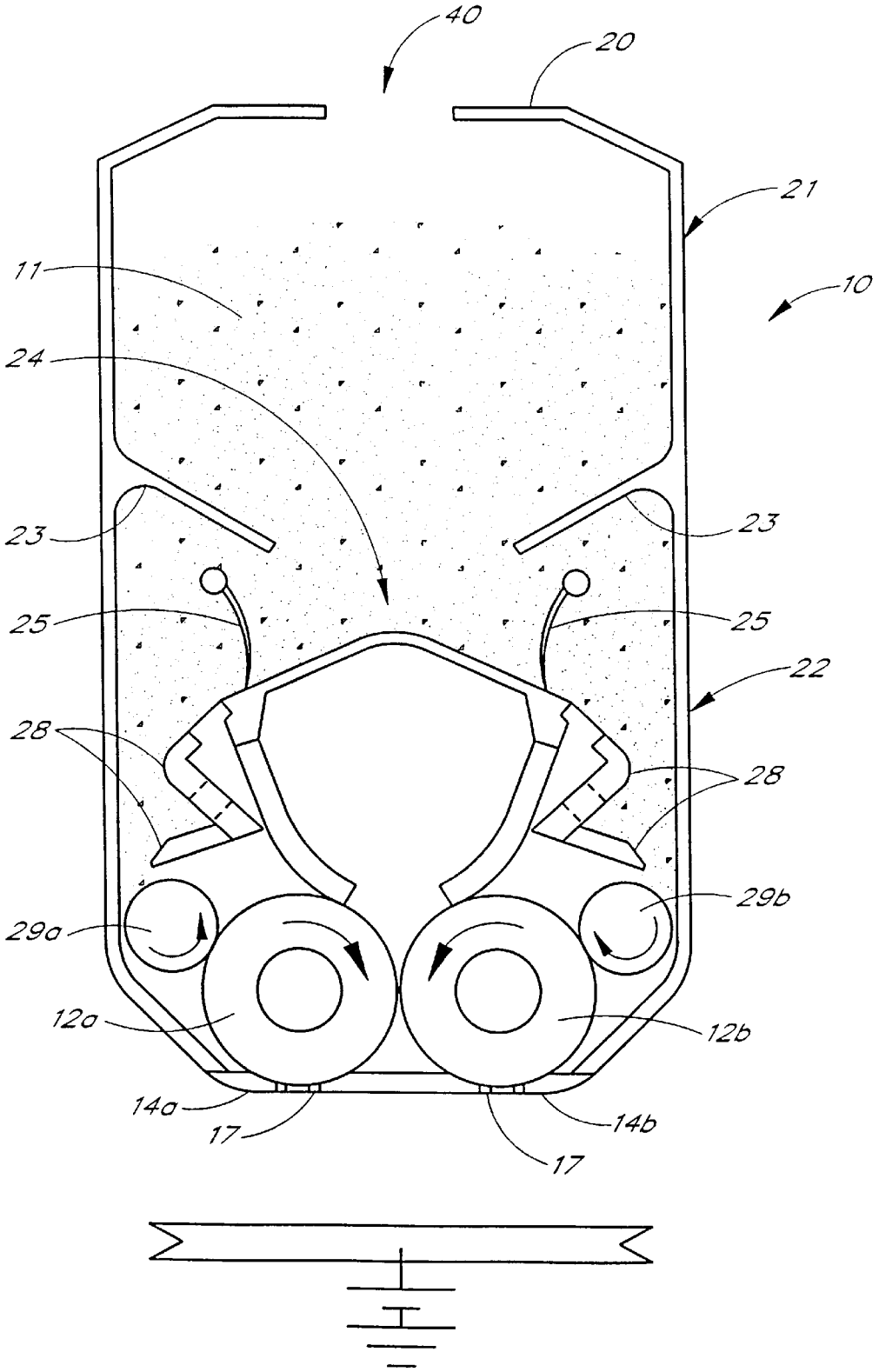
FIG. 11 illustrates an alternative embodiment wherein the toner container is refillable.

In a further alternative illustrated in FIG. 11, the casing 20 in FIG. 4 may be a fixed portion of the printer unit 10 and may be refilled with toner particles through an opening 40.

While preferred embodiments of this invention have been disclosed herein, those skilled in the art will appreciate that changes and modifications may be made thereto without departing from the spirit and scope of the invention as defined in the appended claims.

I claim:

1. A printer which selectively deposits toner particles onto an information carrier, said printer comprising:

a toner container which encloses said toner particles;

a first toner carrier member and a second toner carrier member which receive said toner particles from said toner container;

a back electrode positioned such that the information carrier may be positioned between said toner carrier members and said back electrode; and an electrode unit arranged in communication with said toner container, said electrode unit comprising a plurality of electrodes and apertures, said apertures surrounded at least partly by said electrodes, said electrode unit being arranged to control transportation of said toner particles from said toner carrier members through said apertures toward said back electrode using attraction fields such that said toner particles are selectively deposited on said information carrier, wherein said toner carrier members, said electrode unit and said back electrode interact to form a print zone therebetween, said print zone comprising a first smaller print zone and a second smaller print zone, each of said first smaller print zone and said second smaller print zone including at least respective first and second electrodes of said plurality of electrodes, said first and second electrodes in said first smaller print zone controlling transportation of toner particles from said first toner carrier member to said information carrier, said first and second electrodes in said second smaller print zone controlling transportation of toner particles from said second toner carrier member to said information carrier.

2. The printer unit as defined in claim 1, wherein:

said electrodes are driven by a driving circuit, said driving circuit connected to each electrode by a respective extended portion of said each electrode, said extended portion of each electrode in said first smaller print zone oriented in a first direction from said aperture of said each electrode, said extended portion of each electrode in said second smaller print zone oriented in a second direction from said aperture of said each electrode, said second direction opposite said first direction;

said first toner carrier member rotates in said first direction so that toner on said first toner carrier member passes over said aperture of each electrode of said first smaller print zone before passing over said extended portion of said each electrode; and said second toner carrier member rotates in said second direction so that toner on said second toner carrier member passes over said aperture of each electrode of said second smaller print zone before passing over said extended portion of said each electrode.

3. The printer unit as defined in claim 1, wherein adjacent electrodes in each group are arranged with respect to said toner carrier member such that the respective apertures of said electrodes are spaced from said toner carrier by substantially the same distance.

4. The printer unit as defined in claim 1, wherein said toner container comprises at least one rotating mixing blade.

5. The printer unit as defined in claim 1, wherein each toner carrier member has a respective toner distribution roller positioned proximate to said each toner carrier member.

6. The printer unit as defined in claim 5, further including guide bars positioned to guide toner particles flowing from said toner container to each of said distribution rollers.

7. The printer unit as defined in claim 1, further including at least one spacer positioned proximate to said toner carrier members.

8. The printer unit as defined in claim 1, further including:

a control voltage; and a switch which selectively connects said toner carrier members to said control voltage, said switch operable to control each toner carrier member individually or to control said toner carrier members simultaneously.

9. The printer unit as defined in claim 1, wherein a separate back electrode is provided for each said first smaller print zone and said second smaller print zone.

10. The printer unit as defined in claim 9, further including a switch, said switch connecting each back electrode to a voltage, said switch operable to control each back electrode individually or to control said back electrodes simultaneously.

11. The printer unit as defined in claim 1, wherein said electrode unit includes an area comprising a plurality of conductors connected to a voltage that shields said electrodes, said conductors operating to prevent transportation of the toner particles from said toner carrier members to said information carrier.

12. The printer unit as defined in claim 11, wherein at least a plurality of said conductors in said area extend from said area to locations between said electrodes.

13. The printer unit as defined in claim 1, wherein:

a first plurality of said apertures are located a first distance from one of said toner carrier members, and a second plurality of said apertures are located a second distance from one of said toner carrier members, said first distance greater than said second distance; and said first plurality of said apertures have sizes which are smaller than sizes of said second plurality of said apertures.

14. The printer unit as defined in claim 1, wherein:

a first plurality of said apertures are located a first distance from one of said toner carrier members, and a second plurality of said apertures are located a second distance from one of said toner carrier members, said first distance greater than said second distance; and said first plurality of said electrodes are connected to a higher voltage than said second plurality of said electrodes.

15. The printer unit as defined in claim 1, wherein:

a first plurality of said apertures are located a first distance from one of said toner carrier members, and a second plurality of said apertures are located a second distance from one of said toner carrier members, said first distance greater than said second distance; and said first plurality of said electrodes are connected to a voltage having a first application time, and said second plurality of electrodes are connected to a voltage having a second application time, said first application time being greater than said second application time.

16. The printer unit as defined in claim 1, wherein said toner container is disposable.

17. The printer unit as defined in claim 16, wherein said toner carrier members and said electrode unit are coupled to said toner container and are disposable with said toner container.

18. The printer unit as defined in claim 16, wherein said toner carrier members are coupled to said toner container and are disposable with said toner container.

19. The printer unit as defined in claim 1, wherein said toner container is coupled to said printer unit and is refillable.

20. The printer unit as defined in claim 1, wherein said toner container and said first and second toner carrier members are arranged in a replaceable toner cartridge, said replaceable toner cartridge further including means for connecting said first and second toner carrier members to a control voltage.

21. The printer unit as defined in claim 20, wherein said first and second electrodes of said first smaller print zone are positioned adjacent said first toner carrier member, and wherein said first and second electrodes of said second smaller print zone are positioned adjacent said second toner carrier member, said first and second electrodes of said first smaller print zone and said first and second electrodes of said second smaller print zone surrounding apertures through which said toner particles pass to be applied to an information carrier.

22. The printer unit as defined in claim 21, wherein said first and second electrodes of said first smaller print zone and said first and second electrodes of said second smaller print zone are replaceable and are coupled to said toner container to be replaced when said toner container is replaced.

23. The printer unit as defined in claim 20, wherein said first and second toner carrier members are coupled to said container to be replaced when said container is replaced.

24. The printer unit as defined in claim 20, wherein said printer unit is replaceable.

25. A method to improve printing quality in a printer device in which at least one printer unit is arranged, said printer unit including at least one toner container and an electrode unit, whereby in a print zone, toner particles are transported from a toner carrier member towards an information carrier insertable between the toner carrier member and at least one back electrode by means of one or more attraction fields, the method comprising the steps of:

dividing said print zone into at least a first smaller print zone and a second smaller print zone;

providing at least a first toner carrier member and a second toner carrier member for said at least one toner container, said first toner carrier member associated with said first smaller print zone, said second toner carrier member associated with said second smaller print zone; and arranging apertures and electrodes in said electrode unit in at least a first group and second group, said first group of apertures and electrodes controlling flow of toner particles from said first toner carrier member to said information carrier, said second group of apertures and electrodes controlling flow of toner particles from said second toner carrier member to said information carrier.

26. A printer which selectively deposits toner particles onto an information carrier, said printer comprising:

a toner container which encloses said toner particles;

a first toner carrier member and a second toner carrier member which receive said toner particles from said toner container;

a first back electrode and a second back electrode positioned such that the information carrier may be positioned between said toner carrier members and said back electrodes; and an electrode unit arranged in communication with said toner container, said electrode unit comprising a plurality of electrodes and apertures, said apertures surrounded at least partly by said electrodes, said electrode unit being arranged to control transportation of said toner particles from said toner carrier members through said apertures toward said back electrodes using attraction fields such that said toner particles are selectively deposited on said information carrier, wherein said first toner carrier member, said electrode unit and said first back electrode interact to form a first print zone therebetween, and said second toner carrier member, said electrode unit and said second back electrode interact to form a second print zone therebetween, said first print zone and said second print zone including at least respective first and second electrodes of said plurality electrodes, said first and second electrodes in said first print zone controlling transportation of toner particles from said first toner carrier member to said information carrier, said first and second electrodes in said second print zone controlling transportation of toner particles from said second toner carrier member to said information carrier.

27. The printer unit as defined in claim 26, further comprising:

a control voltage; and a switch interposed between said control voltage and said first and second toner carrier members, said switch operable to apply said control voltage to said first and second toner carrier members individually or simultaneously.

28. The printer unit as defined in claim 26, wherein said toner container and said first and second toner carrier members are arranged in a replaceable toner cartridge, said replaceable toner cartridge further including means for connecting said first and second toner carrier members to a control voltage.

29. The printer unit as defined in claim 28, wherein said first and second electrodes of said first print zone are positioned adjacent said first toner carrier member, and wherein said first and second electrodes of said second print zone are positioned adjacent said second toner carrier member, said first and second electrodes of said first print zone and said first and second electrodes of said second print zone surrounding apertures through which said toner particles pass to be applied to an information carrier.

30. The printer unit as defined in claim 29, wherein said first and second electrodes of said first print zone and said first and second electrodes of said second print zone are replaceable and are coupled to said toner container to be replaced when said toner container is replaced.

31. The replaceable toner cartridge as defined in claim 28, wherein said first and second toner carrier members are replaceable and are coupled to said container to be replaced when said container is replaced.

32. The replaceable toner cartridge as defined in claim 28, wherein said first and second toner carrier members are replaceable and are coupled to said container to be replaced when said container is replaced.

33. The printer unit as defined in claim 28, wherein said printer unit is replaceable.

* * * * *